US007837192B2

(12) United States Patent
Müller et al.

(10) Patent No.: US 7,837,192 B2
(45) Date of Patent: Nov. 23, 2010

(54) APPARATUS FOR ALIGNING SHEETS THROUGH THE USE OF STOPS DISPOSED ON A CYLINDER

(75) Inventors: Andreas Müller, Heidelberg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/405,386

(22) Filed: Mar. 17, 2009

(65) Prior Publication Data

US 2009/0250869 A1 Oct. 8, 2009

(30) Foreign Application Priority Data

Mar. 17, 2008 (DE) ..... 10 2008 014 592

(51) Int. Cl.
*B65H 9/04* (2006.01)

(52) U.S. Cl. ..... 271/245

(58) Field of Classification Search ..... 271/246; 101/232

See application file for complete search history.

(56) References Cited

U.S. PATENT DOCUMENTS 3,281,144 A * 10/1966 Turner ..... 271/243
4,588,184 A 5/1986 Jeschke
5,761,998 A 6/1998 Fricke et al.

FOREIGN PATENT DOCUMENTS

| | | | |
|---|---|---|---|
| DE | 874453 | B | 4/1953 |
| DE | 19600793 | A1 | 7/1997 |
| DE | 102005049401 | A1 | 5/2007 |
| EP | 0120348 | A2 | 10/1984 |
| EP | 1757543 | A2 | 2/2007 |
| GB | 1326891 | A | 8/1973 |

OTHER PUBLICATIONS

German Search Report dated Oct. 22, 2008.

* cited by examiner

*Primary Examiner*—Gene Crawford
*Assistant Examiner*—Gerald W McClain
(74) *Attorney, Agent, or Firm*—Laurence A. Greenberg; Werner H. Stemer; Ralph E. Locher

(57) ABSTRACT

An apparatus for continuous alignment of sheets which are fed to a processing machine, includes an alignment cylinder on which stops for the sheets are disposed. The stops are pivoted out of the periphery of the alignment cylinder and moved on a translational movement path during an alignment phase.

7 Claims, 2 Drawing Sheets

APPARATUS FOR ALIGNING SHEETS THROUGH THE USE OF STOPS DISPOSED ON A CYLINDER

CROSS-REFERENCE TO RELATED APPLICATION

This application claims the priority, under 35 U.S.C. §119, of German Patent Application DE 10 2008 014 592.0, filed Mar. 17, 2008; the prior application is herewith incorporated by reference in its entirety.

BACKGROUND OF THE INVENTION

1. Field of the Invention

The invention relates to an apparatus for aligning sheets through the use of stops disposed on a cylinder of a sheet-processing machine, in particular so-called front lays.

European Patent EP 0 120 348 B1, corresponding to U.S. Pat. No. 4,588,184, discloses providing an alignment cylinder with front lays for reliable front edge alignment during continuous sheet feeding. The front lay stops are firmly connected to the alignment cylinder so as to rotate with it in a row transverse to the sheet transport direction. The front lay stops describe a circular path during the rotation of the alignment cylinder as a result of their configuration on the circumference of the alignment cylinder.

SUMMARY OF THE INVENTION

It is accordingly an object of the invention to provide an apparatus for aligning sheets through the use of stops disposed on a cylinder, which overcomes the hereinafore-mentioned disadvantages of the heretofore-known devices of this general type and which provides an alternative apparatus for the alignment of a sheet moving in the sheet transport direction.

With the foregoing and other objects in view there is provided, in accordance with the invention, a sheet aligning apparatus disposed at an end of a feed table in a sheet processing machine, in particular a printing press. The apparatus comprises an alignment cylinder, stops disposed on the alignment cylinder for sheets conveyed to the stops at a predefined speed, and at least one cam mechanism for producing a translational movement of the stops.

It is a particular advantage of the invention that the front lays execute a translational movement during the alignment process. As a result of this measure, relative movement between the front edge of the sheet and the front lays is avoided.

In an advantageous refinement, a cam mechanism is provided which superimposes a second movement component on the rotational movement of the front lay, so that a translational direction of movement of the front lays is produced. The cam mechanism interacts with a stationary control cam.

Other features which are considered as characteristic for the invention are set forth in the appended claims and further advantageous refinements can be gathered from the subclaims.

Although the invention is illustrated and described herein as embodied in an apparatus for aligning sheets through the use of stops disposed on a cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
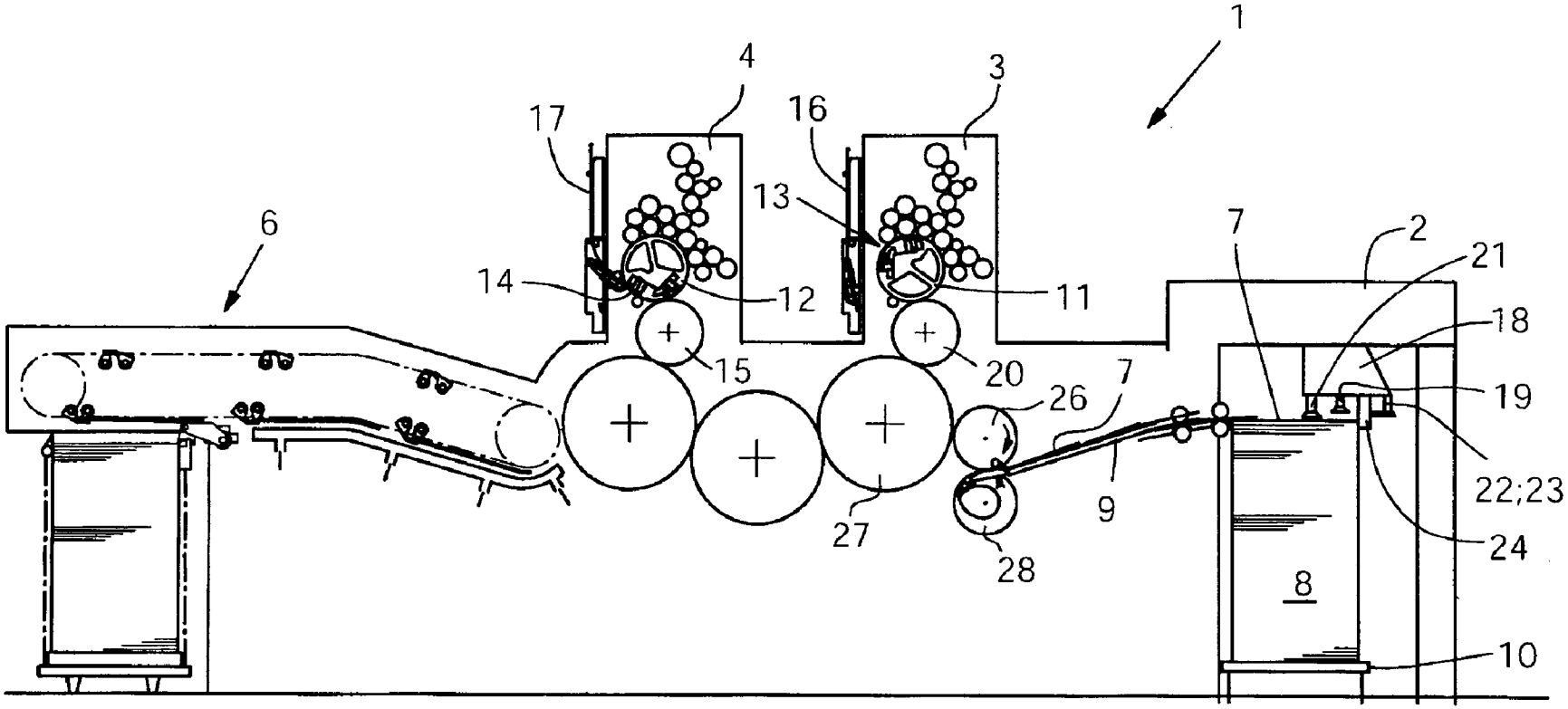
FIG. 1 is a diagrammatic, longitudinal-sectional view of a sheet-processing machine, in particular a printing press.

Referring now to the figures of the drawings in detail and first, particularly, to FIG. 1 thereof, there is seen a machine, for example a printing press 1, for processing sheets 7. The printing press 1 has a feeder 2, at least one printing unit 3 and 4 and a delivery 6. The sheets 7 are removed from a sheet stack 8 and, separated or in overlapping formation, are fed over a feed table 9 to the printing units 3 and 4. The latter each contain, in a known way, a plate cylinder 11, 12 and blanket cylinders 15, 20 interacting therewith in each case. The plate cylinders 11 and 12 each have a clamping device 13, 14 for fixing flexible printing plates. Furthermore, each plate cylinder 11, 12 is assigned an apparatus 16, 17 for semiautomatic or fully automatic printing plate changing.

The sheet stack 8 rests on a stack board 10 which can be raised under control. The sheets 7 are removed from the top side of the sheet stack 8 through the use of a so-called suction head 18 which, inter alia, has a number of lifting and dragging suckers 19, 21 to separate the sheets 7. Furthermore, blowing devices 22 are provided to loosen the upper sheet layers, and sensing elements 23 for stack tracking. A number of side and rear stops 24 are provided in order to align the sheet stack 8, in particular the upper sheets 7 of the sheet stack 8.

At the end of the feed table 9 which, in particular, is a suction conveyor belt table, there is disposed a printing unit cylinder, e.g. a feed cylinder 26, which grips the sheets 7 at their front edge and transfers them to a downstream cylinder 27, for example an impression or printing cylinder.

Figure 2:
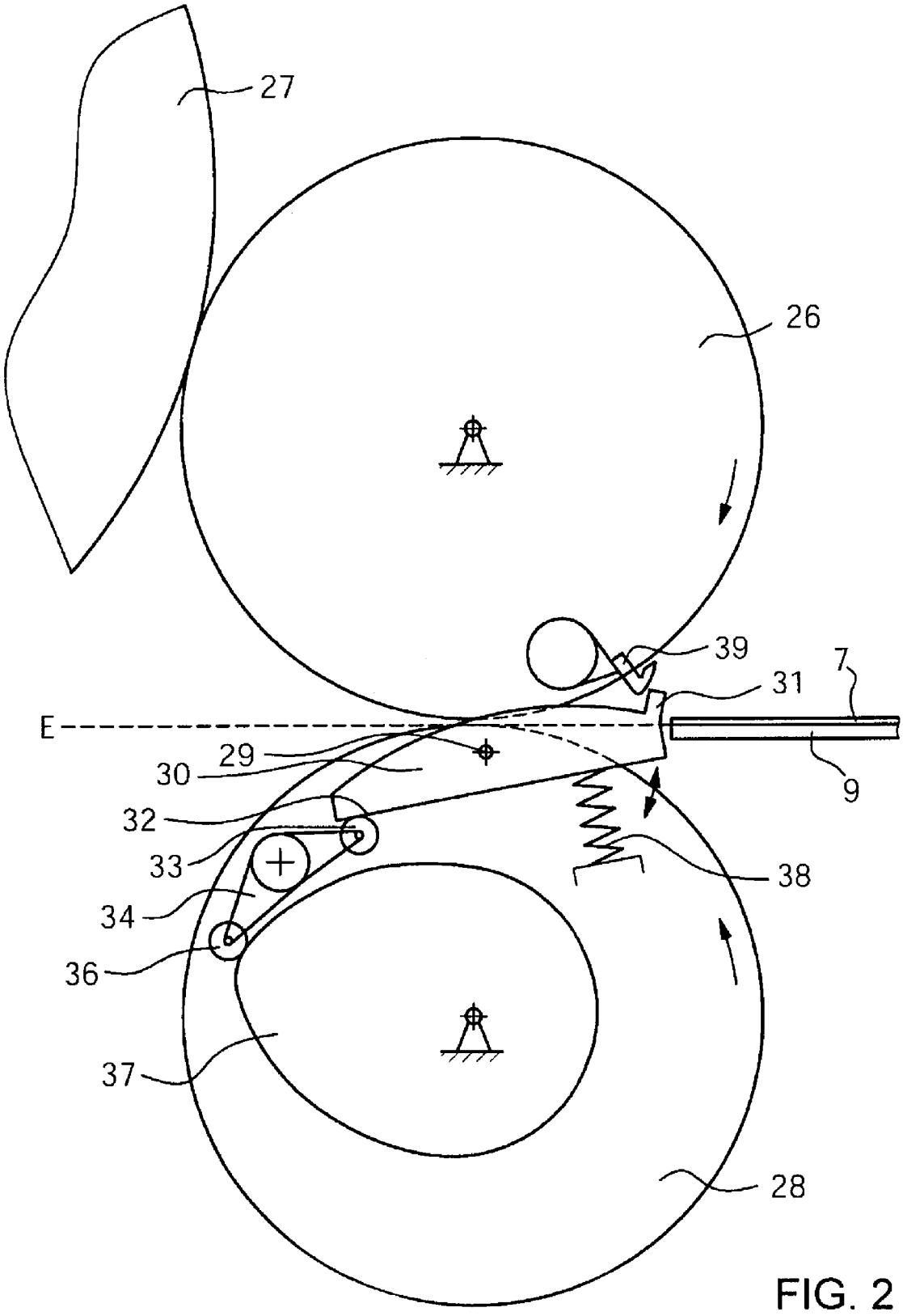
FIG. 2 is an enlarged, longitudinal-sectional view of a feed cylinder having front lays disposed in accordance with the invention.

As is best seen in FIG. 2, an alignment cylinder 28, which is driven at the speed of the feed cylinder 26, is provided underneath the feed cylinder 26, approximately tangentially with respect to a feed plane E formed by the feed table 9. A number of front lay carriers 30, having front lay stops 31, are disposed on a common pivot axis 29, spaced apart from one another transversely with respect to the sheet transport direction. The pivot axis 29 is mounted in such a way that it can pivot on the body of the alignment cylinder 28. In each case, a stop 32 for a control roller 33 is provided at an end of the front lay carrier 30 that is opposite to the front lay stop 31. The control roller 33 is seated in such a way that it can rotate at the end of a double-armed cam lever 34, which is mounted in such a way that it can pivot on a first end of the alignment cylinder 28. A further control roller 36, which is in operative contact with the contour of a control cam 37 that is disposed in a stationary manner, is mounted in such a way that it can rotate at a second end of the double-armed lever 34. A spring 38 supported on the alignment cylinder 28 presses with prestress on the front lay carrier 30, so that the front lay stop 31 is pivoted out of the periphery of the alignment cylinder 28 under the force of the compression spring 38. In this case, the control roller 33 is in continuous contact with the stop 32 of the front lay carrier 30 and controls the movement of the front lay stop 31.

In order to align a front edge of a sheet, the front lay stops 31 are pivoted out of the periphery of the alignment cylinder 28 as far as the plane E. The sheet 7 is conveyed against the front lay stops 31 through the use of transport systems disposed on the feed table 9, for example a suction belt, at a speed $V_1$ which is higher than a speed $V_2$ of the front lay stops 31 in the sheet transport direction. In this case, the sheet 7 is aligned in the sheet transport direction and with respect to a skewed position.

Following completion of an alignment phase, the sheet is picked up by transport grippers 39 of the feed cylinder 26. A speed $V_3$ of the transport grippers 39 is then synchronized with the speed $V_2$ of the stops, which means that the speed $V_2=V_3$ during the closure of the grippers 39.

During the alignment phase, the front lay stops 31 are moved translationally along an imaginary extension—plane E—of the feed table 9. During the alignment phase, the sheet is aligned in the sheet transport direction and with respect to a skewed position on the front lay stops 31 and is then gripped by the transport grippers 39 of the feed cylinder 26. After the closure of the transport grippers 39, the front lay stops 31 dip into the periphery of the alignment cylinder 28 until, shortly before reaching the plane E, they are pivoted out of the periphery of the alignment cylinder 28 again as far as the plane E for the alignment of the next sheet 7.

The invention claimed is:

1. A sheet aligning apparatus disposed at an end of a feed table in a sheet processing machine, the apparatus comprising:

an alignment cylinder;

at least one stop disposed on said alignment cylinder for sheets conveyed at a predefined speed to said at least one stop, said at least one stop performing a rotational movement with said alignment cylinder and a pivoting movement relative to said alignment cylinder; and at least one cam mechanism for producing the pivoting movement being combined with the rotational movement to result in a translational movement of said at least one stop.

2. The apparatus according to claim 1, wherein said at least one stop is configured to pivot out of a periphery of said alignment cylinder.

3. The apparatus according to claim 1, which further comprises:

a roller lever configured to pivot on said alignment cylinder, a front lay body of said at least one stop, and a stationary control cam, said roller lever being operatively connected firstly to said front lay body and secondly to said control cam.

4. The apparatus according to claim 1, wherein said at least one stop is configured to be moved translationally on an imaginary extension of said feed table during an alignment phase of the sheets.

5. The apparatus according to claim 4, wherein a sheet moves at a speed, before striking said at least one stop, being higher than a speed of movement of said at least one stop.

6. The apparatus according to claim 5, which further comprises at least one transport gripper moving at a speed during gripper closure being synchronized with the speed of said at least one stop.

7. The apparatus according to claim 1, wherein the sheet processing machine is a printing press.

* * * * *